US009640351B2

(12) United States Patent
Le Nguyen

(10) Patent No.: US 9,640,351 B2
(45) Date of Patent: May 2, 2017

(54) TEMPERATURE-DEPENDENT SWITCH

(71) Applicant: Thermik Geraetebau GmbH, Sondershausen (DE)

(72) Inventor: Tan Le Nguyen, Sondershausen (DE)

(73) Assignee: THERMIK GERAETEBAU GMBH, Sondershausen (DE)

( * ) Notice: Subject to any disclaimer, the term of this patent is extended or adjusted under 35 U.S.C. 154(b) by 84 days.

(21) Appl. No.: 14/548,358

(22) Filed: Nov. 20, 2014

(65) Prior Publication Data

US 2015/0077213 A1 Mar. 19, 2015

Related U.S. Application Data

(63) Continuation of application No. PCT/EP2014/052618, filed on Feb. 11, 2014.

(30) Foreign Application Priority Data

Feb. 13, 2013 (DE) ..... 10 2013 101 393
Mar. 18, 2013 (DE) ..... 20 2013 101 153 U

(51) Int. Cl.
*H01H 37/54* (2006.01)
*H01H 37/64* (2006.01)
(Continued)

(52) U.S. Cl.
CPC ..... *H01H 37/5409* (2013.01); *H01H 9/36* (2013.01); *H01H 37/04* (2013.01);
(Continued)

(58) Field of Classification Search
CPC ..... H01H 9/36; H01H 37/04; H01H 37/5427; H01H 37/5409; H01H 37/64;
(Continued)

(56) References Cited

U.S. PATENT DOCUMENTS 3,355,563 A * 11/1967 Ruckriegel ..... H01H 37/54 337/346
3,416,115 A * 12/1968 Moorhead ..... H01H 37/54 337/343

(Continued)

FOREIGN PATENT DOCUMENTS

AT 256225 8/1967
DE 977 187 5/1965

(Continued)

OTHER PUBLICATIONS

International Search Report; mailed Apr. 30, 2014; 2 pp.

(Continued)

*Primary Examiner* — Anatoly Vortman

(74) *Attorney, Agent, or Firm* — Harness, Dickey & Pierce, P.L.C.

(57) ABSTRACT

In a temperature-dependent switch having a switching mechanism that has a movable contact part which cooperates with a stationary counter contact and is moved by a spring part to which the movable contact part is electrically conductively connected, the switching mechanism produces an electrically conductive connection between the stationary counter contact and a second counter contact in a temperature-dependent manner. The switch is provided with an arc-shielding plate, which has no mechanical function, is arranged on an upper surface of the spring part and covers sections thereof.

23 Claims, 5 Drawing Sheets

(51) Int. Cl.
*H01H 37/04* (2006.01)
*H01H 9/36* (2006.01)
*H01H 9/30* (2006.01)

(52) U.S. Cl.
CPC ..... *H01H 37/5427* (2013.01); *H01H 37/64* (2013.01); *H01H 37/54* (2013.01); *H01H 2009/305* (2013.01); *H01H 2037/549* (2013.01); *H01H 2037/5454* (2013.01); *H01H 2037/5463* (2013.01); *H01H 2037/5481* (2013.01)

(58) Field of Classification Search
CPC ..... H01H 2037/5454; H01H 2037/549; H01H 2037/5463; H01H 2009/305; H01H 2037/5481; H01H 37/54
USPC ..... 337/333
See application file for complete search history.

(56) References Cited

U.S. PATENT DOCUMENTS 3,564,185 A * 2/1971 Bauer ..... H01H 13/42 200/238
3,902,149 A 8/1975 Senor
4,306,211 A * 12/1981 Hofsass ..... H01H 37/54 337/365
4,470,033 A * 9/1984 Hofsass ..... H01H 37/5427 337/343
4,551,701 A 11/1985 Ubukata et al.
5,107,241 A 4/1992 Ubukata et al.
5,337,036 A * 8/1994 Kuczynski ..... H01H 37/5427 337/343
5,615,072 A * 3/1997 Hofsass ..... H01H 1/504 337/107
5,867,085 A * 2/1999 Kruck ..... H01H 11/0056 337/333
5,877,671 A 3/1999 Hofsäss
5,892,429 A * 4/1999 Hofsass ..... H01H 1/504 337/102
6,133,817 A 10/2000 Hofsäss et al.
2013/0271258 A1* 10/2013 Hofsaess ..... H01H 37/64 337/298

FOREIGN PATENT DOCUMENTS

DE 21 21 802 1/1973
DE 196 23 570 A1 1/1998
DE 198 16 807 A1 10/1999
GB 1 394 612 5/1975

OTHER PUBLICATIONS

ISA/EP; English language translation of International Preliminary Report on Patenability (Chapter 1) for PCT/EP2014/052618; issued by WIPO Aug. 18, 2015; 7 pp.

* cited by examiner

TEMPERATURE-DEPENDENT SWITCH

CROSS-REFERENCES TO RELATED APPLICATIONS

This is a continuation application of co-pending international patent application PCT/EP 2014/052618, filed Feb. 11, 2014 and designating the United States, which was published in English as WO 2014/124929 A1, and claims priority to German patent application DE 10 2013 101 393.7, filed Feb. 13, 2013, and German utility model application DE 20 2013 101 153.3, filed Mar. 18, 2013, which are incorporated herein by reference.

BACKGROUND OF THE INVENTION

The present invention relates to a temperature-dependent switch having a switching mechanism that has a movable contact part, which movable contact part cooperates with a stationary counter contact and is moved by a spring part to which the movable contact part is electrically conductively connected, the switching mechanism producing an electrically conductive connection between the stationary counter contact and a second counter contact in a temperature-dependent manner.

A switch of this type is known for example from DE 196 23 570 A1.

The known switch has a cup-like lower part which is closed by a flat upper part. A temperature-dependent switching mechanism is arranged inside the switch and carries a movable contact part, which cooperates with a stationary counter contact.

The switching mechanism comprises a snap-action spring disc, which carries the contact part and presses it against the stationary counter contact. Here, the snap-action spring disc is supported via its edge on the inner base of the lower part, which forms the second counter contact.

In this position, the two counter contacts are thus electrically conductively interconnected via the movable contact part and the snap-action spring disc.

The external connections are produced via the electrically conductive cover part, which is electrically conductively connected to the stationary counter contact, and via the electrically conductive lower part, on the inner base of which the snap-action spring disc is supported.

Above the snap-action spring disc, a bimetallic snap-action disc is arranged which lies loosely in the switching mechanism in its low-temperature position. In its high-temperature position, its centre presses the movable contact part away from the stationary counter contact, for which purpose it is supported via its edge on an insulating film, which is provided between the lower part and the upper part.

Whereas in the present case the spring part is a snap-action spring disc, against which a bimetallic snap-action disc works, it is also known to use merely a bimetal part as a spring part if the current can be conveyed directly through the bimetal part.

The known temperature-dependent switch is used to protect an electrical device against excessively high temperature. For this purpose, the supply current for the device to be protected is conveyed through the temperature-dependent switch, wherein the switch is coupled thermally to the device to be protected. At a response temperature predefined by the transition temperature of the bimetallic snap-action disc, the respective switching mechanism then opens the electric circuit in that the movable contact part is lifted from the stationary counter contact.

So that the switch does not close again once the device has cooled, it is further known, to provide in parallel to the temperature-dependent switching mechanism a self-holding resistor, preferably a PTC resistor, which, when the temperature-dependent switching mechanism is closed, is electrically short-circuited thereby. If the switching mechanism now opens, the self-holding resistor takes over some of the current flowing previously and in doing so heats up until it generates sufficient heat to keep the bimetallic snap-action disc at a temperature above the response temperature. This process is referred to as self-holding and prevents a temperature-dependent switch from closing again in an uncontrolled manner when the device to be protected cools down again.

Whereas in the case of temperature-dependent switches of this type an inherent heating of the spring part as a result of the flowing current is often undesirable, switches are also known in which a series resistor is additionally provided, which heats up in a defined manner as a result of the flowing current of the device to be protected. If the current flow is too high, this series resistor heats up to such an extent that the transition temperature of the bimetallic snap-action disc is reached. Besides the monitoring of the temperature of the device to be protected, the flowing current can thus also be monitored, and the switch then has a defined current dependency.

The spring part may also be a bimetal spring tongue, as is described in DE 198 16 807 A1. This bimetal spring tongue carries at its free end a movable contact part, which cooperates with a stationary counter contact. The stationary counter contact is electrically connected to a first external connection, wherein a second external connection is electrically connected to the fixed end of the bimetal spring tongue, which acts as a second counter contact.

The bimetal spring tongue, below its response temperature, closes the electric circuit between the two external connections by pressing the movable contact part against the stationary counter contact. In doing so, the bimetal spring tongue conveys the supply current of the electrical device to be protected.

If the temperature-dependent switch is to guide particularly high currents, a current transfer member in the form of a contact bridge or a contact plate is often used, which current transfer member is moved by the spring part and carries two contact parts which cooperate with two stationary counter contacts.

The supply current of the device to be protected thus flows from the first counter contact via the first contact part into the contact plate, through the contact plate to the second contact part and from there into the second counter contact. The spring part is therefore free from current. It is also known to use the spring part itself, that is to say for example a bimetallic snap-action disc or a snap-action spring disc working against a bimetal part, as a contact bridge.

Switches of this type have proven their value sufficiently in everyday use. If the switches do not open at the zero crossing of the AC supply voltage, an arc forms when the movable contact part is lifted from the stationary counter contact and the voltage drop across the switch reduces to the maintaining arc voltage. The voltage drop remains at this level until the applied AC supply voltage changes polarity, that is to say reaches its next zero crossing. The arc is then quenched and the switch is reliably opened.

The forming arcs lead to contact erosion and consequently in the long term to a change of the geometry of the switching areas of the movable contact part and stationary counter contact, which over time also leads to an impairment of the switching response.

In the event of uncontrolled flash-over in the interior of the switch, arcs even cause damage to the spring part. Arcs may also result in the switching areas sticking together, so to speak, such that the switch no longer opens or no longer opens quickly enough.

These problems even increase with the number of switching cycles, such that the switching response of the known switch is impaired over the course of time. Against this background, the life period, that is to say the number of permissible switching cycles of the known switch is limited, wherein the life period is also dependent on the switching power, that is to say the current intensity of the switched currents.

In particular towards the end of the life period of a temperature-dependent switch, the arcs in particular lead to such severe damage to the spring parts that the switch is damaged irreversibly.

Besides the contact erosion at the stationary counter contact and also the movable contact part, damage also occurs at the rim of spring discs, which spring disc carry the movable contact part and via their rim produce the electrical connection to the second counter contact. Over the course of the switching cycles, this leads to damage at the rim of the spring discs, whereby the life period is likewise limited.

On the whole, in the case of the known temperature-dependent switch, there is thus a link between the switching power and the maximum life period. The end of the life period of a switch is always accompanied by increasingly stronger arcs, which leads to contact erosion and sparks flying around, which damage the spring parts in the interior of switches of this type.

DE 977 187 A, in the case of a temperature-dependent switching mechanism that merely carries a bimetallic snap-action disc as a spring part, therefore proposes relieving this spring part of the current flow by connecting the movable contact part to the housing of the switch via a sun-gear-like metal spider which is supported internally on the switch. The current thus no longer flows through the bimetallic snap-action disc, but predominantly through the metal spider.

A similar approach is selected by AT 256 225 A, in which a copper branching is provided on the surface of the bimetallic snap-action disc remote from the stationary counter contact and connects the movable contact part to the housing.

In a development of the concepts from these two documents, DE 21 21 802 A proposes arranging, parallel to the bimetallic snap-action disc, a snap-action spring disc that produces the closing pressure of the switching mechanism and also carries the electric current. The bimetallic snap-action disc is thus relieved both mechanically and electrically, such that its life period is considerably extended.

Even with these switches, there is still the problem mentioned at the outset of the inevitably forming arcs that limit the life period of the known switch to a greater extent, the higher the switched current.

SUMMARY OF THE INVENTION

In view of the above, one object of the present invention is to increase, with simple design, the life period and/or the switching power of the known temperature-dependent switch.

This and other objects are achieved in accordance with the invention in that the switching mechanism has an arc-shielding plate devoid of mechanical function that is arranged on the spring part on the upper surface thereof facing the stationary counter contact and covers sections of said upper surface.

The inventors of the present application have specifically identified that, especially at the end of the life period of a temperature-dependent switching mechanism, the root of the arc migrates from the movable contact part to the spring part, thereby, due to the extremely low thickness of the spring part, then eventually causing holes to be burned into the spring part or relatively large quantities of metal oxide to be deposited thereon.

Even by covering merely sections of the upper surface of the spring part, protection is provided unexpectedly against spraying sparks and metal oxides and also against direct contact with the root of the arc.

Astonishingly, this extremely simple measure causes the life period of the new switch to be extended with otherwise identical design and identical current intensity, wherein it has even been found that the current intensity and the life period can even increase simultaneously.

Document U.S. Pat. No. 4,551,701 A discloses a temperature-dependent switch having an arc-shield of heat-resistant material for protecting a current-carrying bimetal spring tongue from being directly exposed to radiation heat of arcs generated between a fixed counter contact and a movable contact part arranged at a free end of the bimetal spring tongue.

Document U.S. Pat. No. 5,107,241 A discloses a comparable switch.

Here, it is sufficient if the arc-shielding plate covers 50% at most of the upper surface of the spring part.

In an experiment, it has been established by way of example that, in the case of an existing switch having a life period of 2,500 switching cycles at 50 A, an arc-shielding plate with a covering as presented hereinafter in FIG. 3 causes the life period to continue even after 6,000 switching cycles with identical current intensity. Initial tests indicate that the switched current intensities can be increased here even to 75 A.

In this context, it should be considered that the temperature-dependent switches referred to herein have diameters in the range from 10 to 20 mm and have a height in the range from 3 to 6 mm. The movable contact part has a diameter from 2 to 4 mm, wherein the thicknesses of the snap discs involved are considerably below 1 mm.

It has been found that the thickness of the arc-shielding plate may even lie in the region of 0.05 mm without impairing the protective function.

In the context of the invention, an arc-shielding plate "devoid of mechanical function" is understood to mean a sheet metal part that does not contribute to the mechanical switching response. It does not exert any spring effect that could influence the movement of the movable contact part when the switch is opened or closed, that is to say in the simplest case it is a purely passive component which still demonstrates the aforesaid protective effect to an outstanding level.

In addition, it has been found that it is not necessary to cover the entire upper surface of the spring part with the arc-shielding plate, such that, due to the low thickness of the arc-shielding plate and the smaller area thereof compared with the area of the spring part, the switching response of the switch itself, in particular the response rate, is not impaired.

All these results, which can be produced with simple design and in a cost-effective manner, even in existing switch models, were unexpected on account of the prior art.

In one embodiment, the arc-shielding plate is electrically conductively connected to the movable contact part.

Without being bound to this explanation, the inventors of the present application assume in a first explanation attempt that, due to the electrical connection between the arc-shielding plate and the movable contact part, the root of the arc when migrating from the movable contact part does not migrate to the spring part, but instead to the arc-shielding plate, although this covers only part of the upper surface of the spring part.

This also was unexpected, but enables geometric shapes for the arc-shielding plates that can be accommodated in terms of design without difficulty in existing switches and do not impair the switching response, but still improve the life period and the intensity of the current to be switched.

According to one object, the arc-shielding plate comprises a closed annular region, which closed annular region covers, on the upper surface of the spring part, an annular area extending around the movable contact part.

The inventors have recognized that protection is thus provided around the entire movable contact part and prevents migration of the root of the arc to the spring part itself so reliably that the life period can be extended even further.

According to one embodiment, the annular region extends until below the movable part.

This measure is advantageous in terms of design since the electrically conductive connection between the arc-shielding plate and the movable contact part is thus produced reliably.

The annular area may have a width which corresponds from 10% to 40% of the diameter of the movable contact part.

Tests have revealed that this annular width is sufficient to reliably prevent a further migration of the root of the arc from the arc-shielding plate to the spring part.

According to another object, the arc-shielding plate has at least one strip which extends radially from the annular region, wherein three strips starting in a star-shaped manner from the annular region may be provided, of which at least one strip may extend as far as the edge of the spring part.

In this way, the covered region is extended in segments further to the edge of the spring part.

Tests have shown that the root of the arc settles on these strips and does not damage the interposed uncovered regions of the upper surface of the spring part.

According to a still further object, the arc-shielding plate is electrically conductively connected to the second counter contact.

This measure has the advantage that the arc-shielding plate also leads at least some of the current through the switch, which in particular ensures that arcs produced when the switch is opened are not conveyed to the spring part, but are reliably conveyed to the arc-shielding plate.

In one embodiment, the arc-shielding plate is manufactured in one piece from a copper sheet, which may have a thickness of less than 0.1 mm, wherein the copper sheet may be silver-coated.

In the case of this measure, it is advantageous on the one hand that a technically very simple arc-shielding plate can be used that can be produced easily and cost-effectively, such that the costs of the new switch increase only indiscernibly with respect to known switches.

It is further advantageous that this very thin cooper sheet does not in any way negatively impair the mechanical switching response of the new switch because it cannot exert a spring effect.

It was unexpected that such thin copper sheets would provide effective protection against the damage that is caused by arcs produced when the switch is opened, in particular after many switching cycles, that is to say towards the end of the life period.

Astonishingly, the arc-shielding plates also exhibit no significant damage in the previous tests carried out by the applicant, even in new switches disassembled after many switch cycles, that is to say the arc-shielding plates simply did not sustain the damage otherwise produced on the spring part.

Generally, the spring part may be disc-shaped and electrically conductively connected via its rim to the second counter contact, at least when the switch is closed.

Whereas the effect of the new arc-shielding plate can be used with any geometric shape and arrangement of the spring part, particular advantages are provided with disc-shaped spring parts, because these are used in switches that have penetrated the market particularly well.

The design according to the invention can also be used in switches that, as a spring part, have a bimetal part on which two movable contact parts are provided which cooperate with two stationary counter contacts. This switch thus has two switch contacts, at which arcs may form. Each of the two contact parts on the bimetal part, which can be formed as a disc or strip, can be surrounded by its own arc-shielding plate in the above-described sense, wherein the arc-shielding plates may also be interconnected.

According to one object, the spring part is a temperature-dependent bi-stable snap-action disc having a first geometric temperature position, in which it lifts the movable contact part from the stationary counter contact, and a second geometric temperature position, in which it presses the movable contact part against the stationary counter contact.

The bi-stable snap-action disc, which may be a bimetal or trimetal snap-action disc, here, in the case of the closed switch, provides both the contact pressure between the stationary counter contact and the movable contact part and also the electrically conductive connection between the two counter contacts.

This design concerns switches of simple construction, which are not preferred per se due to the conduction of current through the bimetal part. Due to the use of the arc-shielding plate however, the life period and the intensity of the admissible switching current can be increased even in the case of temperature-dependent switches of such simple design.

According to another object, the spring part is a spring disc which presses the movable contact part towards the stationary counter contact, and if the switching mechanism further comprises a temperature-dependent snap-action disc which, in a geometric temperature position, lifts the movable contact part from the stationary counter contact.

In this embodiment it is advantageous that the snap disc is relieved of the current flow, wherein the closing pressure also is no longer provided by the snap disc. A basic design of this type is known for example from document DE 196 23 570 A1 mentioned at the outset.

The movable contact part may be arranged centrally on the snap disc and/or spring disc and the switch may comprise a housing, on which the two counter contacts are provided and in which the switching mechanism is arranged.

Here, the spring disc is preferably fixed via its rim to the housing, which preferably has a lower part closed by an upper part, the stationary counter contact being arranged on an inner face of the upper part.

These improvements are advantageous in terms of design because they lead to easily constructed and mechanically stable temperature-dependent switches which have very reliable switching response and can be produced cost-effectively.

Further advantages will emerge from the description and the accompanying drawing.

Of course, the features mentioned above and the features yet to be explained below can be used not only in each of the specified combinations, but also in other combinations or in isolation, without departing from the scope of the present invention.

BRIEF DESCRIPTION OF THE DRAWINGS

Embodiments of the invention are illustrated in the accompanying drawing and will be explained in greater detail in the following description. In the drawings.

DESCRIPTION OF PREFERRED EMBODIMENTS

Figure 1:
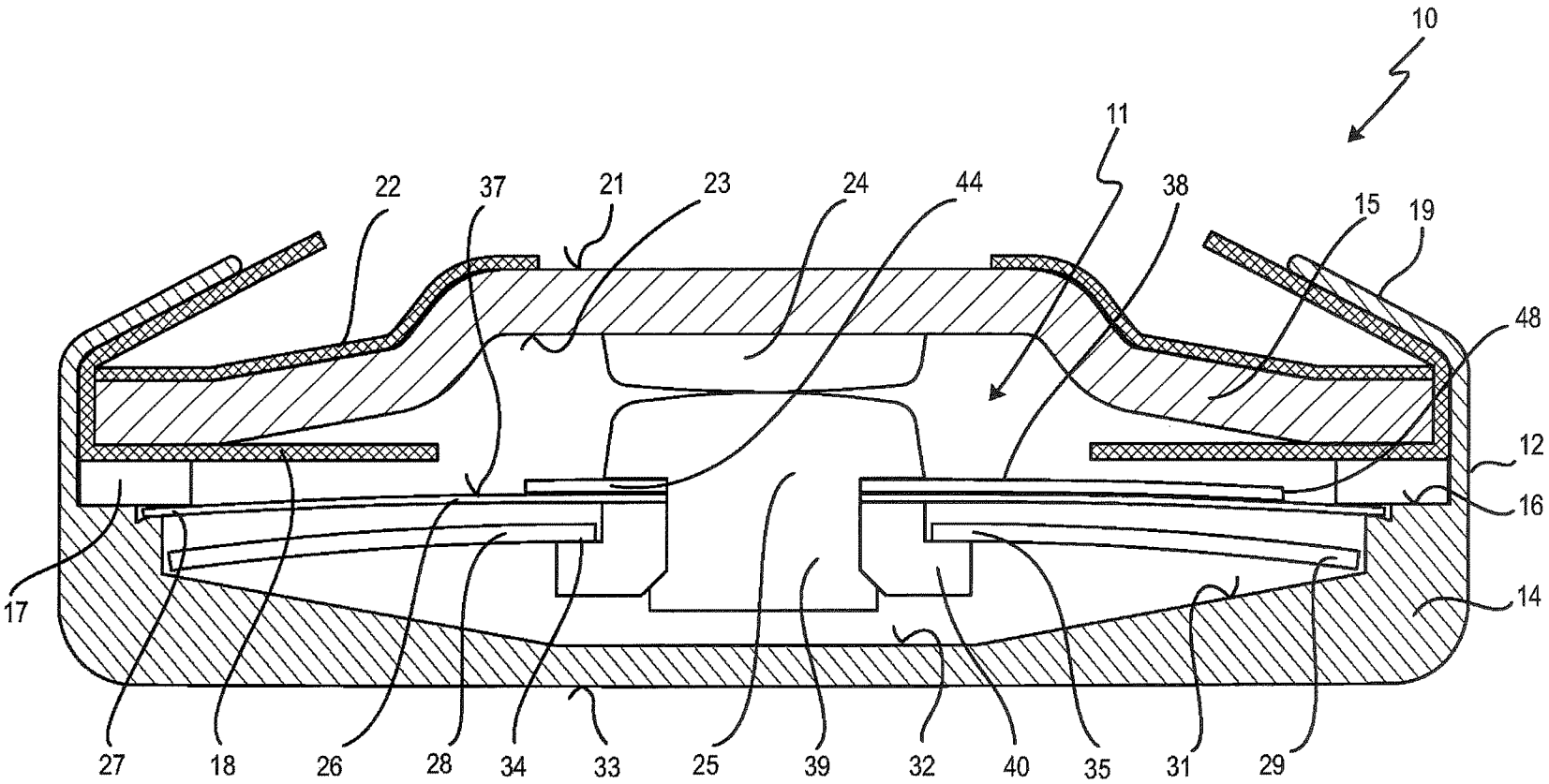
FIG. 1 shows a schematic side view of a temperature-dependent switch with arc-shielding plate, in the closed state.

FIG. 1 shows a schematic side view of a temperature-dependent switch 10, which is circular in plan view and has a temperature-dependent switching mechanism 11 which is arranged in a housing 12.

The housing 12 comprises a cup-like lower part 14, which is closed by an upper part 15. In the lower part 14, a peripheral shoulder 16 is provided, on which a spacer ring 17 is arranged, on which the upper part 15 rests with intermediate positioning of an insulating film 18.

The lower part 14 holds the upper part 15 on the peripheral rim 16 by means of its inwardly bent upwardly protruding edge 19.

The lower part 14 and upper part 15 are manufactured in the shown embodiment from electrically conductive material, which is why the insulating film 18 is provided and electrically insulates the lower part 14 and the upper part 15 with respect to one another.

A further insulating covering 22 is provided on an outer surface 21 of the upper part 15, whereas a stationary counter contact 24 is arranged on an inner surface 23 of the upper part 15.

A movable contact part 25 carried by the switching mechanism 11 cooperates with this stationary counter contact 24.

The switching mechanism 11 comprises a snap-action spring disc 26, which is fixed via its rim 27 between the ring 16 and the lower part 14, such that it produces an electrically conductive connection there.

Figure 2:
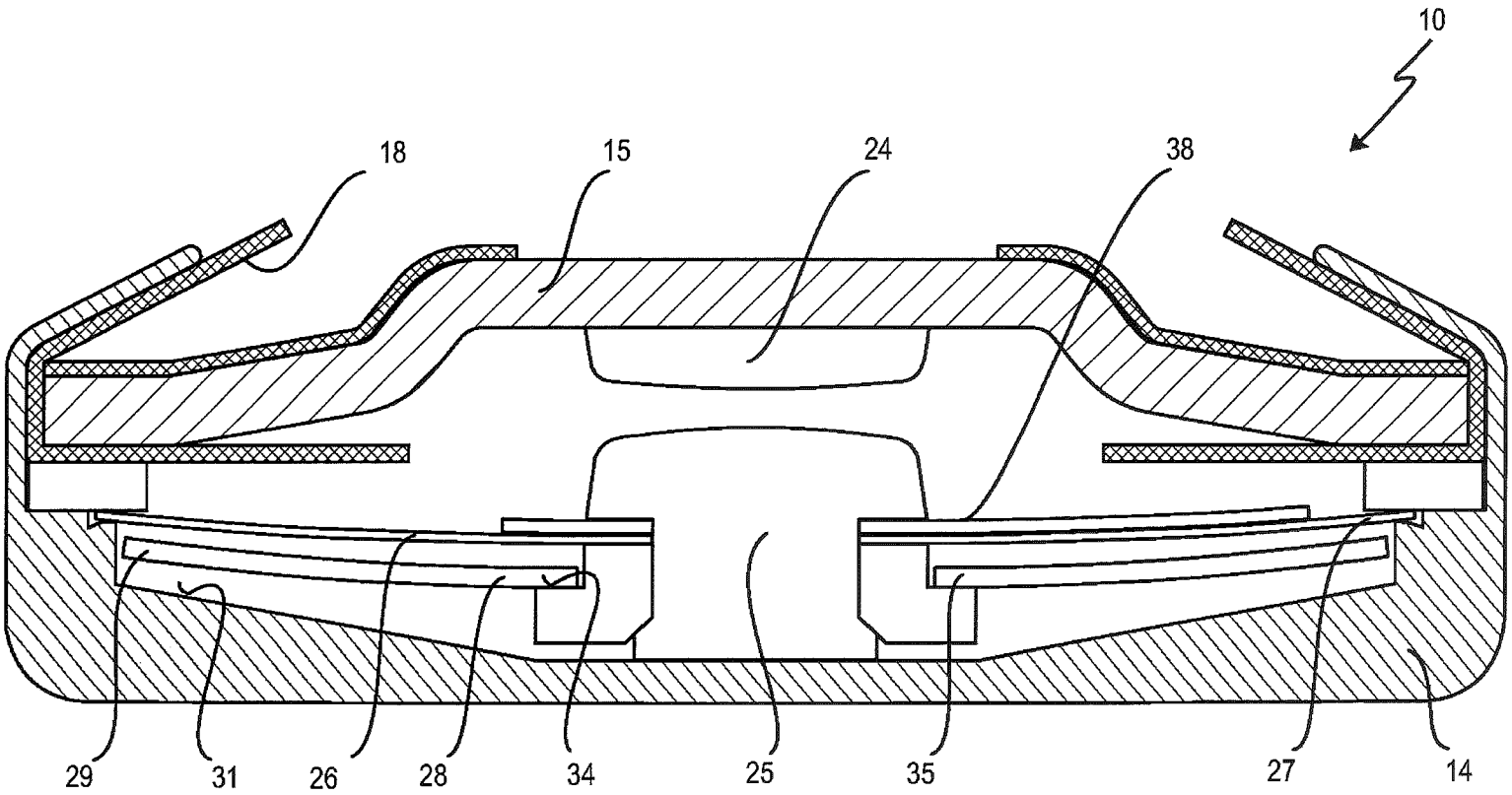
FIG. 2 shows the switch from FIG. 1 in the open state.

A bimetallic snap-action disc 28 is provided beneath the snap-action spring disc 26 and has two geometric temperature positions—the low-temperature position shown in FIG. 1 and the high-temperature position shown in FIG. 2.

The bimetallic snap-action disc 28 lies with its rim 29 freely above a wedge-shaped peripheral shoulder 31, which is formed on an inner base 32 of the lower part 14.

The lower part 14 also has an outer base 33, which together with the outer surface 21 of the upper part 15 serves as the external connection of the switch 10 from FIG. 1.

The bimetallic snap-action disc 28 is supported by its center 35 on a peripheral shoulder 34 of the contact part 25.

In the closed switch position of the switch 10 shown in FIG. 1, the movable contact part 25 is pressed against the stationary counter contact 24 by the snap-action spring disc 26. Because the electrically conductive snap-action spring disc 26 is connected via its rim 27 to the lower part 16, which serves here as a second counter contact of the switching mechanism 11, an electrically conductive connection is thus produced between the two external connections 21, 33.

If the temperature in the interior of the switch 10 now rises beyond the response temperature of the bimetallic snap-action disc 28, this thus turns from the convex configuration shown in FIG. 1 into a concave configuration, in which its rim 29 in FIG. 1 moves upwardly, such that it contacts the rim 27 of the snap-action spring disc 26 from below.

Here, the bimetallic snap-action disc 28 presses via its center 35 against the shoulder 34 and thus lifts the movable contact part 25 from the stationary counter contact 24, as is shown in FIG. 2.

The snap-action spring disc 26 may be a bi-stable spring disc, which is also geometrically stable in the position in FIG. 2, such that the movable contact part 25 then also does not contact the stationary counter contact 24 again if the rim 29 of the bimetallic snap-action disc 28 no longer presses against the rim 27 of the snap-action spring disc 26.

If the temperature in the interior of the switch 10 now drops again, the rim 29 of the bimetallic snap-action disc 28 in FIG. 2 thus moves downwardly and contacts the wedge-shaped shoulder 31. The bimetallic snap-action disc 28 then presses via its center 35 against the snap-action spring disc 26 from below and presses this back into its other geometrically stable position, in which it presses the movable contact part 25 against the stationary counter contact 24 in accordance with FIG. 1.

When passing from the closed switch position according to FIG. 1 into the open switch position according to FIG. 2, an arc is produced between the stationary counter contact 24 and the movable contact part 25 and leads to contact erosion and, after repeated switching cycles and consequent damage to the surfaces of the contact part 25 and counter contact 24, migrates to the spring part carrying the movable contact part 25. This spring part is the snap-action spring disc 26 in the present embodiment, wherein, instead of the snap-action spring disc 26, merely the bimetallic snap-action disc 28 may also be provided, which then for example would be fixed by its rim 29 beneath the peripheral ring 16, although this is not necessary.

In order to now avoid or at least considerably reduce the damage caused by the arcs produced, an arc-shielding plate 38 is arranged on the snap-action spring disc 26, more specifically on its upper surface 37 facing the stationary counter contact 24, and is electrically conductively connected to the movable contact part 25, but mechanically is devoid of function.

The arc-shielding plate 38 is a part stamped from a copper sheet having a thickness of 0.05 mm, such that it performs no spring function at all and does not mechanically load or impair the switching movement of the switching mechanism 11.

This arc-shielding plate 38 nevertheless causes both the switched current intensity and the life period of the switch 10 to be considerably increased compared to a switch of identical design, but without an arc-shielding plate 38.

As can be seen in FIG. 1, the movable contact part 25 has a pin 39, onto which a ring 40 is pressed, such that both the snap-action spring disc 26 and the arc-shielding plate 38 are fixed between the ring 40 and the contact part 25. The shoulder 34 on which the center 35 of the bimetallic snap-action disc 28 rests is formed on the ring 40.

Figure 3:
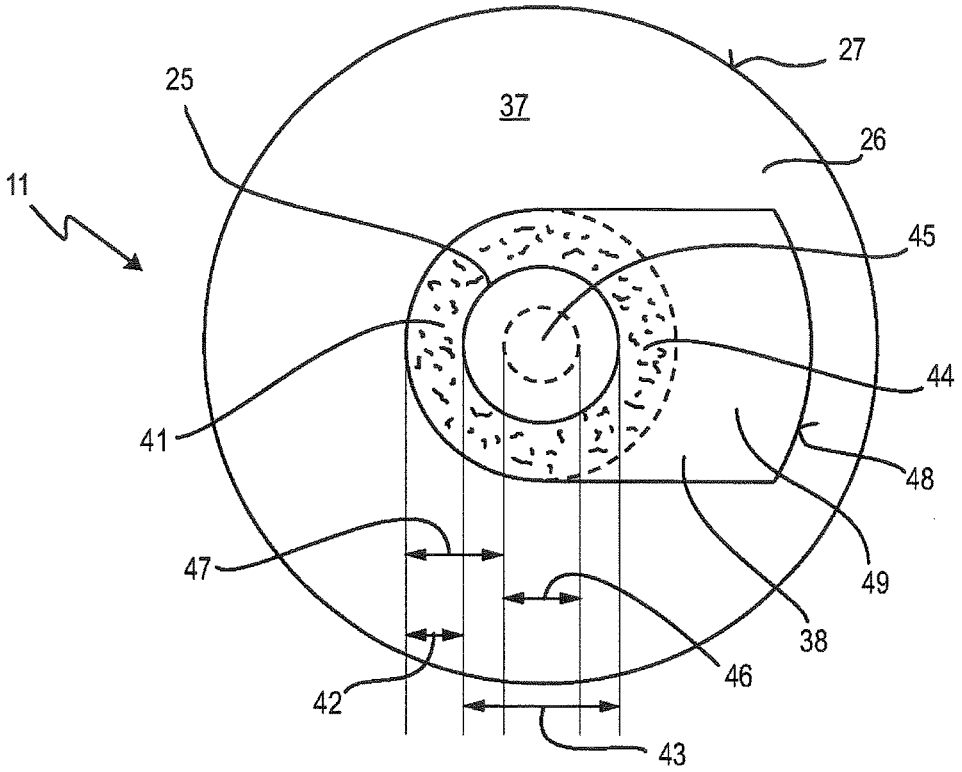
FIG. 3 shows a plan view of the switching mechanism from the switch from FIG. 1.

FIG. 3 shows a plan view of the temperature-dependent switching mechanism 11 from the switch 10 according to FIGS. 1 and 2.

It can be seen in FIG. 3 that the arc-shielding plate 38 covers an annular area 41 on the upper surface 37 around the movable contact part 25, said annular area having a width 42 that is approximately 30% of the diameter 43 of the movable contact part 25.

The closed annular area 41 bears directly against the movable contact part 25 because the arc-shielding plate 38 has an annular region 44 which is illustrated in a dotted manner in FIG. 3 and extends beneath the movable contact part 25, where it has a through-opening 45, of which the diameter 46 corresponds to the diameter of the pin 39 of the movable contact part 25.

The dotted annular region 44 has a width indicated at 47 that is smaller than the diameter 43 of the contact part 25.

A strip 49 of the arc-shielding plate 38 extends from the annular region 44 to a rim 48 in the direction of the edge 27 of the snap-action spring disc 26.

The arrangement is selected such that the rim 48 is set back so far from the rim 27 that the arc-shielding plate does not reach as far as the spacer ring 17, as can be seen in FIG. 1.

Already this shielding plate 38, which covers approximately 30% of the upper surface 37, leads to the effect described in detail in the introduction, in accordance with which the life period and the breaking capacity of the switch are considerably increased.

Figure 4:
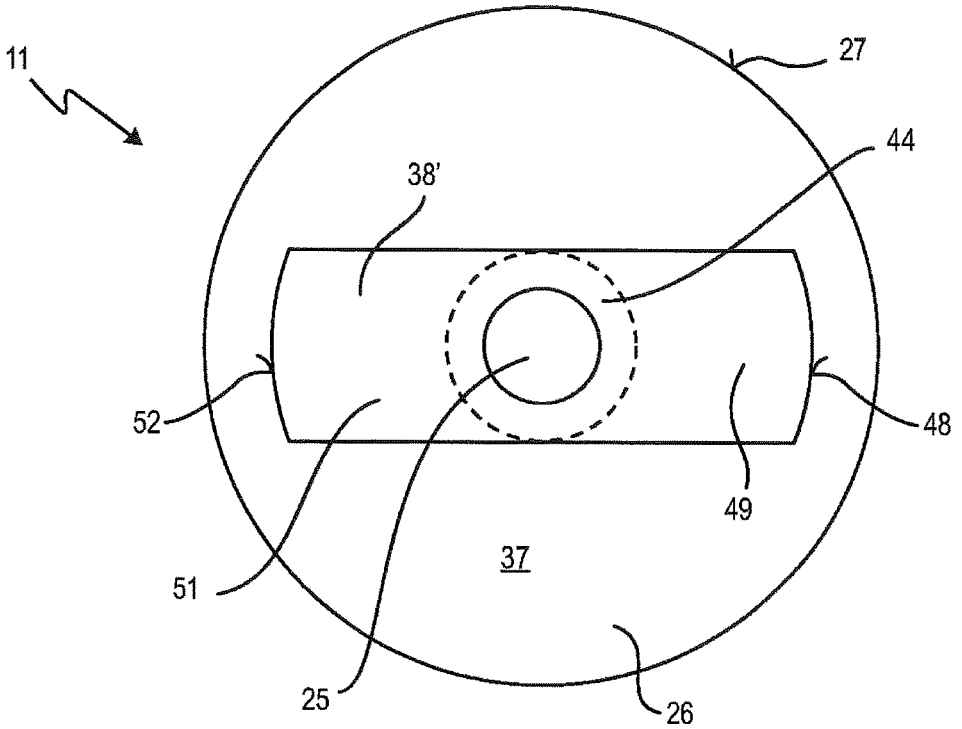
FIG. 4 in an illustration similar to FIG. 3 shows a switching mechanism with a further embodiment for an arc-shielding plate.

FIG. 4, in an illustration similar to FIG. 3, shows the switching mechanism 11 with a further embodiment for the arc-shielding plate 38'. The annular region 44 can again be seen around the movable contact part 25, a first strip 49 now extending to the right from said annular region to the rim 38 and a second strip 51 now extending to the left from said annular region to a rim 52 which, similarly to the rim 48, does not reach as far as the rim 27 of the snap-action spring disc 26.

The covered area of the upper surface 37 is enlarged by the arc-shielding plate 38' to approximately 40% compared with the embodiment according to FIG. 3, which leads to better protection still.

Figure 5:
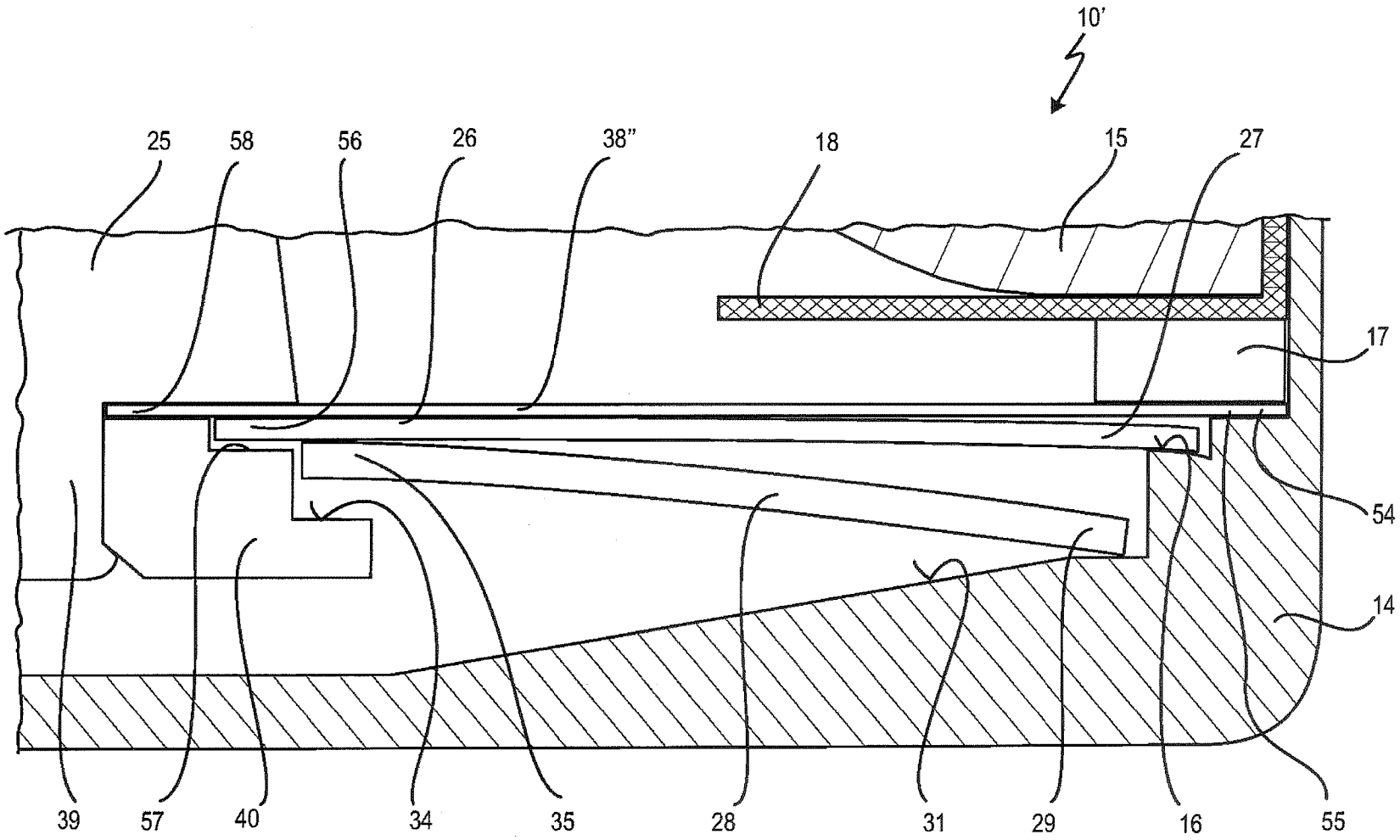
FIG. 5 shows an illustration, enlarged in portions, of a temperature-dependent switch in which the arc-shielding plate is connected to the lower part of the housing.

Whereas, in accordance with the embodiments in FIGS. 1 to 4, the arc-shielding plate 38, 38' is indeed electrically connected to the movable contact part 25, but does not reach beyond the snap-action spring disc 26, an embodiment is shown in FIG. 5 in which the arc-shielding plate 38" is also electrically conductively connected to the second counter contact, that is to say the lower part 14.

The right lower region of a temperature-dependent switch 10' is shown in part in FIG. 5 and for the rest is constructed similarly to the switch 10 from FIGS. 1 and 2. The differences will be explained below.

A recess 54 is provided in the spacer ring 17 and is designed such that an end 55 of the arc-shielding plate 38" protrudes there, such that it is fixed between the spacer ring 17 and lower part 14.

The snap-action spring disc 26 now rests via its center 56 on a shoulder 57 of the ring 40, that is to say is no longer securely fixed between the movable contact part 25 and the ring 40.

By contrast, the arc-shielding plate 38" is fixed via its center 58 between the movable contact part 25 and the ring 40.

The arc-shielding plate 38" is thus electrically connected both to the movable contact part 25 and to the lower part 14, that is to say the second counter contact of the switch 10'.

Figure 6:
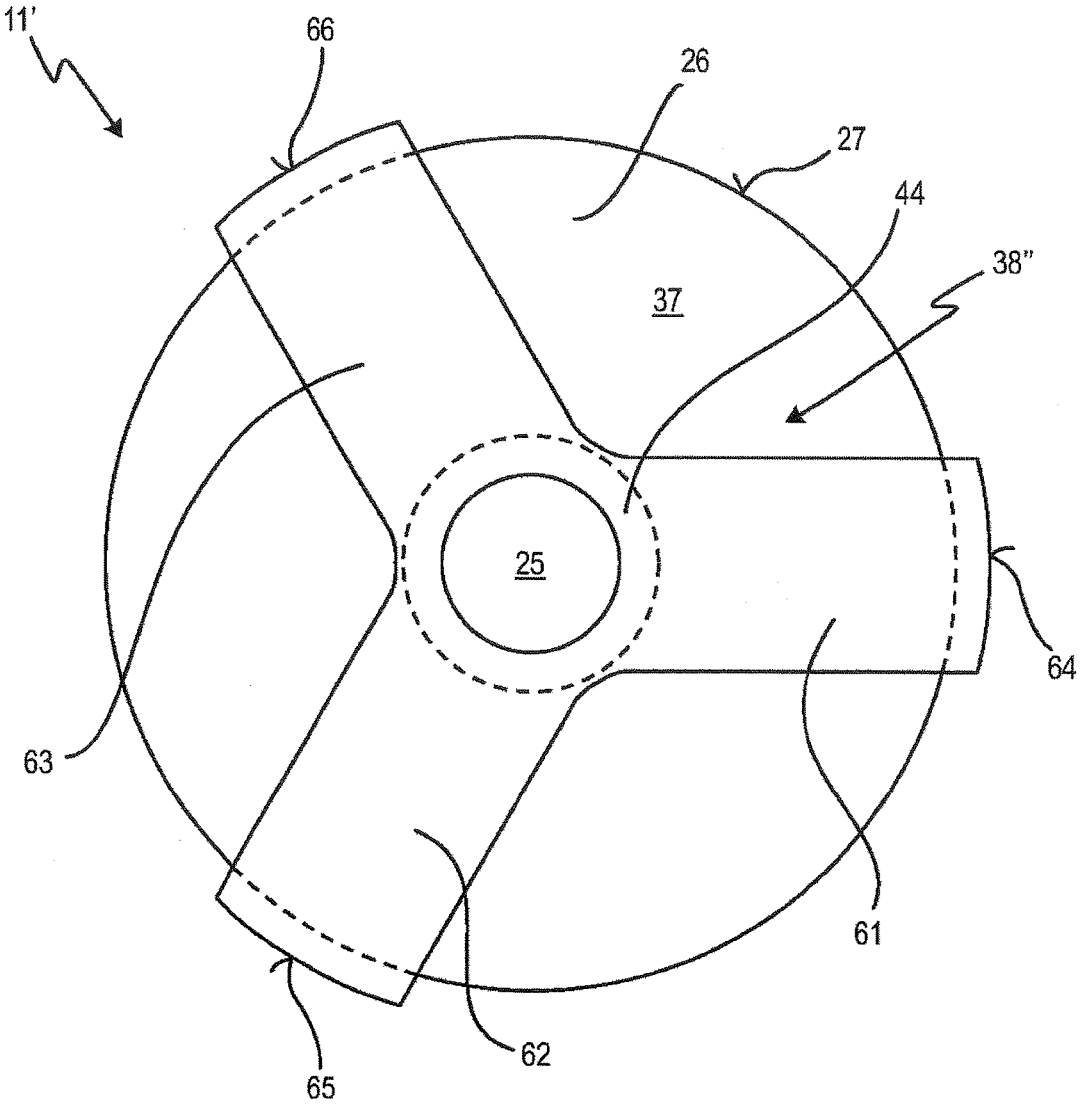
FIG. 6 shows a plan view of the switching mechanism from the switch from FIG. 5.

A plan view of the switching mechanism 11' from the switch 10' according to FIG. 5 is shown in FIG. 6.

The arc-shielding plate 38" again comprises the annular region 44, which extends beneath the movable contact part 25. Three strips 61, 62, 63 proceed in a star-shaped manner from this annular region 44, the rims 64, 65, 66 of said strips protruding beyond the rim 27 of the snap-action spring disc 26, such that they reach into the recess 54 in the spacer ring 17.

It can be seen from FIG. 6 that, even with the arc-shielding plate 38", more than 50% of the upper surface 37 of the snap-action spring disc 26 remains uncovered by the arc-shielding plate 38".

Therefore, what is claimed is:

1. A temperature-dependent switch provided with a stationary counter contact, a second counter contact, and a switching mechanism, said switching mechanism comprising a spring part and a movable contact part, said spring part having an upper surface facing said stationary counter contact, wherein said movable contact part is electrically conductively connected to said spring part, cooperates with said stationary counter contact and is moved by said spring part, the switching mechanism producing an electrically conductive connection between the stationary counter contact and said second counter contact in a temperature-dependent manner, the switching mechanism comprising further an arc-shielding plate having no mechanical function and being arranged on said upper surface of said spring part, said arc-shielding plate covering at least one area of said upper surface, wherein the arc-shielding plate comprises a closed annular region, said closed annular region covering said at least one area on said upper surface of said spring part, said at least one area being an annular area extending around the movable contact part, and wherein the arc-shielding plate comprises three strips extending in a star-shaped manner from the annular region.

2. The switch of claim 1, wherein said arc-shielding plate is electrically conductively connected to said movable contact part.

3. The switch of claim 1, wherein said annular region extends beneath the movable contact part.

4. The switch of claim 1, wherein the movable contact part has a diameter and the annular area comprises a width that corresponds to from 10% to 40% of said diameter of said movable contact part.

5. The switch of claim 1, wherein at least one strip extends at least as far as a rim of the spring part.

6. The switch of claim 1, wherein the arc-shielding plate is electrically conductively connected to the second counter contact.

7. The switch of claim 1, wherein the arc-shielding plate is manufactured in one piece from a copper sheet which has a thickness of less than 0.1 mm.

8. The switch of claim 1, wherein the arc-shielding plate is manufactured in one piece from a copper sheet.

9. The switch of claim 7, wherein the copper sheet is silver-coated.

10. The switch of claim 1, wherein the spring part is disc-shaped and is electrically conductively connected via its rim to said second counter contact, at least when said switch is closed.

11. The switch of claim 1, wherein the spring part is a spring disc which presses the movable contact part towards the stationary counter contact, the switching mechanism further comprising a temperature-dependent snap disc which, in one geometric temperature position, lifts the movable contact part from the stationary counter contact.

12. The switch of claim 11, wherein the movable contact part is arranged centrally on the spring disc.

13. The switch according of claim 1, further comprising a housing on which the stationary counter contact and the second counter contact) are provided, the switching mechanism being arranged within said housing.

14. The switch of claim 13, wherein the spring disc has a rim, the spring disc being fixed via its rim to the housing.

15. The switch according to claim 13, wherein the housing comprises a lower part and an upper part having an inner surface and closing said lower part, the stationary counter contact being arranged on said inner surface of the upper part.

16. The switch of claim 1, wherein the arc-shielding plate covers up to a maximum of 50% of said upper surface of said spring part.

17. The switch of claim 1, wherein the spring part is a temperature-dependent bi-stable snap disc having a first geometric temperature position, in which it lifts the movable contact part from the stationary counter contact, and a second geometric temperature position, in which it presses the movable contact part against the stationary counter contact.

18. The switch of claim 17, wherein the movable contact part is arranged centrally on the snap disc.

19. The switch of claim 17, wherein the bi-stable snap disc is a bimetal or a trimetal snap disc.

20. A temperature-dependent switch provided with a stationary counter contact, a second counter contact, and a switching mechanism, said switching mechanism comprising a spring part and a movable contact part, said spring part having an upper surface facing said stationary counter contact, wherein said movable contact part is electrically conductively connected to said spring part, cooperates with said stationary counter contact and is moved by said spring part, the switching mechanism producing an electrically conductive connection between the stationary counter contact and said second counter contact in a temperature-dependent manner, the switching mechanism comprising further an arc-shielding plate that does not contribute to any mechanical switching function of said switch, said arc-shielding plate being arranged on said upper surface of said spring part and covering at least one area of said upper surface, wherein the spring part is a spring disc which presses the movable contact part towards the stationary counter contact, the switching mechanism further comprising a temperature-dependent snap disc which, in one geometric temperature position, lifts the movable contact part from the stationary counter contact and wherein the arc-shielding plate is permanently electrically conductively connected to the second counter contact.

21. The switch of claim 20, wherein the movable contact part is arranged centrally on the spring disc.

22. The switch of claim 20, wherein the arc-shielding plate comprises a closed annular region, said closed annular region covering said at least one area on said upper surface of said spring part, said at least one area being an annular area extending around the movable contact part.

23. The switch of claim 22, wherein the arc-shielding plate comprises at least one strip extending radially from said annular region.

* * * * *